United States Patent [19]

Werth et al.

[11] Patent Number: 4,583,809

[45] Date of Patent: Apr. 22, 1986

[54] ELECTRICAL CONNECTOR ASSEMBLY HAVING MEANS FOR EMI SHIELDING

[75] Inventors: Dee A. Werth, Bainbridge; Robert W. Brush, Sr., Unadilla; Paul I. Pressel, Vestal, all of N.Y.

[73] Assignee: Allied Corporation, Morris Township, Morris County, N.J.

[21] Appl. No.: 595,879

[22] Filed: Apr. 2, 1984

[51] Int. Cl.[4] ..... H01R 13/658; H01R 17/18

[52] U.S. Cl. ..... 339/143 R; 339/177 R

[58] Field of Search ..... 339/14 R, 89 C, 90 C, 339/143 R, 177 R, 177 E, DIG. 2

[56] References Cited

U.S. PATENT DOCUMENTS

| | | | |
|---|---|---|---|
| 2,762,025 | 9/1956 | Melcher | 339/143 |
| 2,958,750 | 11/1960 | Lebens | 200/133 |
| 3,099,506 | 7/1963 | Tuchel | 339/143 |
| 3,171,706 | 3/1965 | Daniels | 339/143 |
| 3,281,756 | 10/1966 | O'Keefe | 339/89 |
| 3,336,566 | 8/1967 | Barker | 339/143 |
| 3,408,610 | 10/1968 | Clarkston | 339/8 |
| 3,448,430 | 6/1969 | Kelly | 339/143 |
| 3,537,065 | 10/1970 | Winston | 339/177 R |
| 3,659,251 | 4/1972 | Fish | 339/143 |
| 3,944,317 | 3/1976 | Oberdiear | 339/143 |
| 3,990,765 | 11/1976 | Hill | 339/177 |
| 4,008,943 | 2/1977 | Flatt | 339/111 |
| 4,126,372 | 11/1978 | Hashimoto | 339/177 |
| 4,243,290 | 1/1981 | Williams | 339/143 |
| 4,248,492 | 2/1981 | Snyder | 339/89 |
| 4,296,986 | 10/1981 | Herrmann | 339/89 |
| 4,330,166 | 5/1982 | Cooper | 339/143 |
| 4,408,821 | 10/1983 | Forney, Jr. | 339/177 R |

*Primary Examiner*—Gil Weidenfeld
*Assistant Examiner*—Steven C. Bishop
*Attorney, Agent, or Firm*—C. D. Lacina

[57] ABSTRACT

A continuous 360° electrically conductive seal between a back shell (30) and an electrically conductive cable braid (46) is provided by a pair of coaxial sleeves (68, 74), a ferrule (56), and an annular shoulder (80), the conductive seal resulting from interference fitting between the sleeves, ferrule and back shell and the shoulder plastically deforming. Outer sleeve (68) is interference fit in ferrule (56). Inner sleeve (74) has its outer periphery interference fit within the outer sleeve and within the back shell. The annular shoulder extends outwardly from the inner sleeve to define forward and rearward facing V-shaped teeth and is comprised of a malleable material adapted to plastically deform within respective teeth extending rearwardly and forwardly from the outer sleeve and the back shell.

6 Claims, 4 Drawing Figures

ELECTRICAL CONNECTOR ASSEMBLY HAVING MEANS FOR EMI SHIELDING

This invention relates to an electrical connector assembly having means for shielding the assembly from electro-magnetic interference (EMI).

In recent years a need has developed that electrical connector assemblies provide effective shielding against EMI to signal-carrying conductors and, in certain military applications, to withstand severe EMI conditions caused by or generated by electro-magnetic pulses (EMP). To protect the signal-carrying conductors from entry of external EMI and the surrounding area from EMI leakage, both a shielded cable and an internal ground strap has been used. Electrical connectors satisfying U.S. military standards (e.g., MIL-C-38999, MIL-C-26482, etc.) utilize electrically conductive shells having external thread on its back shell for threadably connecting with internal thread of an accessory boot for supporting the cable to the shell and a continuous plurality of aftwardly extending V-shaped teeth around its end face which match with accessory teeth for non-rotatably locking the two together.

However, it has been found that electro-magnetic and radio frequency signals can enter or leave an otherwise shielded plug and receptacle connector assembly through the connected threads and through slight mismatch between the locking teeth. Hence, the importance of maintaining a continuous 360° electrically conductive shield around the cable connection at the rearward end portion of the connector assembly is now recognized.

Accordingly, one object of the present invention is to provide an electrical connector designed to meet EMI shielding criteria while continuing to satisfy presently established electrical and mechanical performance specifications. Another object of the present invention is provision of an EMI shielding arrangement which provides a continuous 360° seal of electrically conductive material between the back shell and the cable braid shield around the termination of the cable to the shell. Still another object of the invention is provision of an electrical connector assembly which utilizes metal-to-metal abutment between a conductive ferrule attached to the braid and an electrically conductive adapter to electrically couple the braid to the back shell. Yet another object is to provide a pair of electrically conductive sleeves which electrically seal by an interference fit within the connector and an annular shoulder of electrically conductive material which plastically deforms to electrically seal around the back shell and the ferrule.

In furtherance of these and other objects, the electrical connector assembly of the present invention comprises an electrically conductive shell of the type having a mating front portion, a generally cylindrical rear portion or back shell having a transverse end face comprised of a plurality of aftwardly extending V-shaped teeth, an electrical contact carried in the shell for mating, means including an accessory boot of electrically conductive material mounted to the back shell for connecting and supporting a cable from the back shell, means for shielding the shell against electro-magnetic interference, and a coaxial-type cable having a conductive braid shield encircling a center conductor passing through the accessory boot and terminated to the contact.

In accord with the present invention, shield means are provided for establishing a continuous 360° electrically conductive seal around the back shell to protectively shield the signal carrying conductors against electro-magnetic interference. The shield means are comprised of a ferrule of electrically conductive material in electrical circuit relation to said shield, a pair of concentric sleeves of electrically conductive material adapted to be in electrical circuit relation by interference fitting contact with themselves, the ferrule and the back shell, and an annular shoulder of electrically conductive and plastically deformable material adapted to be in electrical circuit relation by plastically deforming against the sleeves and the back shell.

The outer sleeve has a forward face comprising a plurality of forwardly facing V-shaped teeth. The annular shoulder extends radially outward from and around the outer periphery of the inner sleeve to describe forward and rearward axial faces comprised of, respectively, forwardly and rearwardly facing V-shaped teeth adapted to mesh with the forward and rearward teeth extending, respectively, from the outer sleeve and the back shell.

When the accessory boot is rotatably coupled onto the back shell, the ferrule advances the sleeve axially against the back shell and the forwardly and rearwardly facing teeth from the annular shoulder plastically deform to seal any cracks between the teeth within which they are meshed and any circumferential gaps which exist between the interference fit portions.

One way of carrying out the invention is described in detail below with reference to the drawings which illustrates specific embodiments of this invention, in which.

Figure 1:
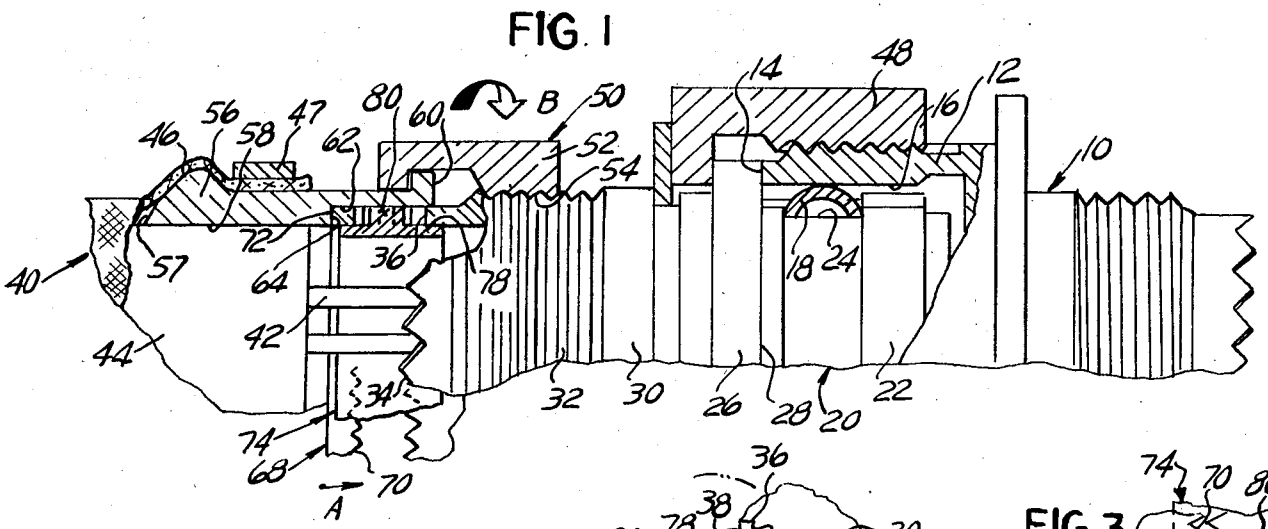
FIG. 1 shows a partial cross-section of an electrical connector assembly having an arrangement providing EMI shielding around the back shell of a plug connector.

Referring to the drawings, and particularly to FIG. 1, an electrical connector assembly includes a plug connector member 20 terminating a shielded cable 40, a receptacle connector member 10, a coupling ring 48 rotatably mounted to the plug connector member for coupling the connector members together, and a grounding strap 18 for shielding the electrical connector assembly from EMI. The cable 40 comprises one or more center conductors 42, a dielectric body 44 surrounding the conductors, and a conductive braid shield 46 surrounding the dielectric. An accessory boot 50 is mounted to the plug connector member for supporting the cable to the back shell of the plug connector. Although not shown, a like accessory boot and shielded cable would extend from the receptacle connector.

Plug connector member 20 comprises an electrically conductive metallic shell having a mating forward end portion having an outer periphery 24, a conductor receiving back shell or rearward end portion 30, and a radial flange 26 medially of its end portions and having an end wall 28 facing forwardly. The back shell 30 includes external thread 32 therearound and transverse end face 34 comprising a plurality of aftwardly extending V-shaped teeth or serrations having valleys 36 and peaks 38, the teeth being provided to facilitate non-rotational connection thereto of an auxiliary accessory.

Receptacle connector member 10 is compatible for mating to plug connector 20 and will not be described since its details would be understood by one of ordinary skill in the art of assembling electrical connectors. It might be noted that the receptacle includes a generally cylindrical shell 12 of electrically conductive material which, when mated, has a forward end face 14 abutting the end wall 28 of flange 26 and its inner surface 16 compressing the grounding strap 18 radially inward against the outer periphery 24 of the plug shell. Also and for the same reasons to be described, the rearward end face of its back shell includes a plurality of V-shaped serrations.

Accessory boot 50 includes a generally cylindrical ferrule 56 of electrically conductive material, and a coupling nut 52. Ferrule 56 includes a front face 60, a back face 57, and a stepped bore extending coaxially between the front and back faces and comprising a forward bore 62 and a rearward bore 58, the back face 57 and rearward bore 58 being adapted to slidably insert between the braid shield 46 and the dielectric 44. The coupling nut 52 is rotatably mounted to the ferrule and includes internal thread 54 for engaging external thread 32 on back shell 30.

To assure complete EMI shielding of the cable where joined to the plug connector, a continuous 360° electrically conductive seal is provided between the braid, the accessory boot, and the back shell. An end portion of braid shield 46 is fitted tightly about the back face 57 of ferrule 56 and a clamping ring 47 is crimped radially inward and therearound to secure the braid to the sleeve and support the cable to the back shell when the accessory boot has been positioned relative to the back shell of the plug connector member, the inward crimping forming a continuous 360° electrically conductive seal between the braid and the ferrule.

Ferrule 56 includes a pocket defined by the cylindrical sidewall forming forward bore 62 and a transverse end wall 64 defining the transition between the bores, the pocket extending coaxially rearward from the front face 60 to the transverse end wall 64.

A pair of concentric sleeves 68, 74 of electrically conductive material are mounted adjacent to the back shell and the front face of the ferrule. The outer sleeve 68 is disposed in the pocket such that the outer periphery thereof is interference fit against the sidewall of forward bore 62, a rearward axial end face 72 thereof is abutting the end wall 64, and a forward axial end face 70 thereof is comprised of a plurality of V-shaped teeth. The inner sleeve 74 has a rearward and a forward outer periphery 76, 78 and a medial annular shoulder 80 extending radially outward from and around the outer periphery thereof, the rearward outer periphery 76 having a diameter which is adapted to interference fit within the inner periphery of outer sleeve 68 and the forward outer periphery 78 having a diameter which is adapted to interference fit within the inner periphery of back shell 30. The annular shoulder 80 defines forward and rearward axial end faces comprised of a plurality of forward facing and rearward facing V-shaped teeth 84, 82 with the rearward facing teeth 82 being adapted to engage the V-shaped teeth 70 extending forwardly from the outer sleeve 68 and the forward facing teeth 84 being adapted to engage the V-shaped teeth extending aftwardly from the back shell.

Annular shoulder 80 is comprised of an electrically conductive material capable of being plastically deformed, such as, but not limited to deadsoft copper, deadsoft aluminum, silver, or one of the many highly conductive metal or graphite loaded elastomeric materials available from a number of commercial manufacturers. The term "deadsoft" generally connotes a material which is as soft (i.e., pliable) as possible without going fluid.

As the coupling nut is rotated in the direction shown by "B", the outer sleeve 68 moves axially in the direction shown by "A" to draw the outer sleeve against the inner sleeve 74 with further rotation drawing the inner sleeve against the back wall. Still further rotation causes the teeth 82, 84 extending from annular shoulder 80 to plastically deform, thereby sealing any axial mismatch between meshed teeth sets 70, 82 and 84, 34 as well as sealing any radial mismatch to fill any circumferential cracks about the sleeves, the back shell, and the ferrule.

The interference fit by the inner sleeve 74 within the outer sleeve 68 and within the back shell 30 provides an electrically conductive circuit path 360° therearound to shield the signal carrying conductors against EMI entering and to prevent leakage therefrom. The plastic deformation of annular shoulder 80 provides an electrically conductive seal between the end faces of ferrule 56 and back shell 30 and the teeth.

Figure 2:
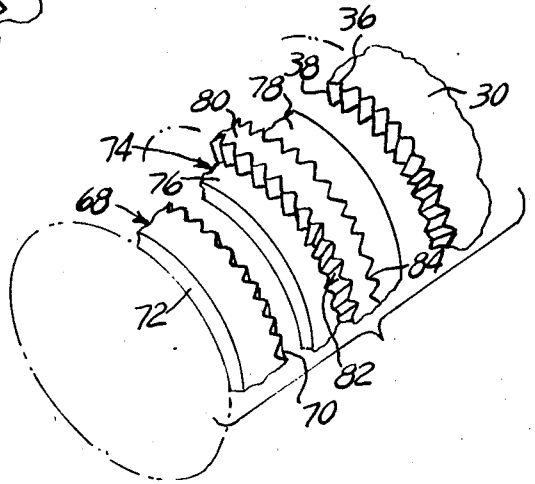
FIG. 2 shows a pair of annular rings positioned adjacent to V-shaped teeth extending from the back shell.

FIG. 2 shows, with details of the electrical connector assembly being omitted for clarity, the outer sleeve 68, the inner sleeve 74, the back shell 30, the shoulder 80 disposed between the sets of teeth, and the respective sets of teeth being positioned for engagement.

Figure 3:
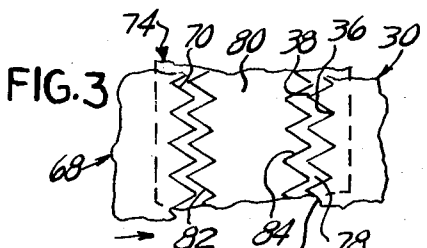
FIG. 3 is a plan view of the pair of rings and the teeth registered for mating.

FIG. 3 shows a plan view of the sleeves and the teeth being prepared for mating. In this view the peaks and valleys of the teeth extending forwardly and rearwardly from the annular shoulder 80 are aligned.

Figure 4:
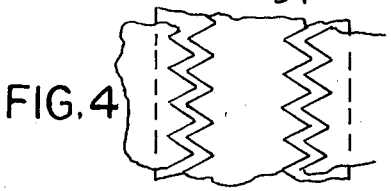
FIG. 4 is an alternate arrangement for the teeth.

FIG. 4 shows an alternate configuration of the second ring where the peaks and valleys of the teeth extending from the annular shoulder 80 are offset.

We claim:

1. An electrical connector assembly including a generally cylindrical back shell of electrically conductive material and having an inner wall and a plurality of afterwardly extending first teeth, a cable having a center conductor encircled by a conductive braid received within and extending outwardly from said backshell, means including an accessory boot of an electrically conductive material for connecting the cable to the back shell, and means for shielding the center conductor against electro-magnetic interference, characterized by said means for shielding providing a continuous 360° electrically conductive seal around and between said back shell and the braid and comprising a ferrule of electrically conductive material connected to the braid in electric circuit relation and having its interior wall circumposing the center conductor, an outer sleeve of electrically conductive material in electrical circuit relation to said ferrule and having a forward axial end face, an inner sleeve of electrically conductive material having a rearward and a forward outer periphery with the outer diameter of each said periphery, respectively, being slightly greater than the inner diameter forming the interior wall of said outer sleeve and the inner wall of said back shell so as to interference fit therewithin and form a continuous 360° electrical seal therebetween, and an annular shoulder comprised of an electrically conductive, plastically deformable, material interposed between the forward axial end face of said ferrule and the first teeth of said back shell, said annular shoulder including a forward and a rearward end face with the rearward end face being adapted to plastically deform around the forward axial end face of the outer sleeve and the forward end face being adapted to plastically deform against said first teeth when compressed thereagainst to complete a continuous 360° electrically conductive seal.

2. The assembly as recited in claim 1 wherein said annular shoulder extends radially outward from said inner sleeve, and the forward axial end face of the outer sleeve is comprised of a plurality of second V-shaped teeth.

3. The assembly as recited in claim 2 wherein said forward end face of the annular shoulder comprises a plurality of V-shaped third teeth extending forwardly and configured to mesh with the aftwardly extending first teeth on the back shell.

4. The assembly as recited in claim 3 wherein said rearward end face comprises a plurality of V-shaped fourth teeth extending aftwardly and adapted to mesh with the forwardly facing second teeth extending from the outer sleeve.

5. The assembly as recited in claim 1 wherein said ferrule comprises a front face and a bore having an interior wall extending rearwardly therefrom and terminating at a transverse end wall to define a cylindrical pocket, and said outer sleeve has its outer periphery interference fit against said interior wall to provide a continuous 360° electrically conductive seal therebetween.

6. An electrical connector assembly comprising an electrically conductive shell including a generally cylindrical back shell having a plurality of teeth extending aftwardly therefrom, a conductor having a conductive braid therearound and having an end portion extending into said backshell, and means for providing a continuous 360° electrically conductive seal between said backshell and said braid whereby to shield the conductor against electro-magnetic interference, including a ferrule of electrically conductive material in electrical circuit relation to said braid, a sleeve of electrically conductive material surrounding said conductor and in electrical circuit relation to the back shell and to said ferrule, and an annular flange of relatively soft malleable material which is plastically deformed axially between said back shell and said sleeve.

* * * * *